United States Patent [19]

Carter

[11] Patent Number: 4,502,254

[45] Date of Patent: Mar. 5, 1985

[54] KNIFE SHARPENER AND MOUNTING BRACKET THEREFOR

[75] Inventor: Larry D. Carter, Mosinee, Wis.

[73] Assignee: Oy Fiskars AB, Helsinki, Finland

[21] Appl. No.: 454,498

[22] Filed: Dec. 29, 1982

[51] Int. Cl.[3] ..... B24D 15/08

[52] U.S. Cl. ..... 51/214; 76/88

[58] Field of Search ..... 51/211-214, 51/330, 354; 76/82, 82.2, 86, 88; 269/290; 248/313, 316 D

[56] References Cited

U.S. PATENT DOCUMENTS

| | | | |
|---|---|---|---|
| 123,386 | 2/1872 | Echternach et al. | 76/86 |
| 2,453,207 | 11/1948 | Dunn | 51/211 R |
| 2,598,589 | 5/1952 | Murchison | 76/86 |
| 2,762,597 | 9/1956 | Jaworski | 248/313 |
| 4,090,418 | 5/1978 | Ishida | 76/84 |

FOREIGN PATENT DOCUMENTS

| | | | |
|---|---|---|---|
| 2603 | of 1868 | United Kingdom | 76/86 |

*Primary Examiner*—Frederick R. Schmidt
*Assistant Examiner*—Robert Rose
*Attorney, Agent, or Firm*—James E. Nilles; Thomas F. Kirby

[57] ABSTRACT

A knife sharpener for sharpening kitchen knives and embodying coarse and fine sharpening devices is adapted to be hand-held during use or to be releasably mounted in a stationary position during use on a storage and mounting bracket which can be permanently attached to a supporting object such as a table, a counter or a wall. The knife sharpener comprises a handle, a head having two slots in which sharpening devices are mounted, a protective flange between the handle and head, and detent-engaging recess at the extreme outer ends of the handle and head. The storage and mounting bracket comprises a base plate, screw holes for attaching the bracket to a supporting object, upwardly projecting slightly flexible members at opposite ends of the base plate, and a detent on each upwardly projecting member for releasable engagement with an associated detent-engaging recess on the knife sharpener.

5 Claims, 9 Drawing Figures

KNIFE SHARPENER AND MOUNTING BRACKET THEREFOR

BACKGROUND OF THE INVENTION

1. Field of Use

This invention relates generally to an improved knife sharpener and a mounting and storage bracket therefor, which sharpener can be hand-held or stationarily mounted on the bracket during use.

2. Description of the Prior Art

The prior art discloses many examples of hand-held sharpeners for kitchen knives or the like (see U.S. Pat. Nos. 1,573,879; 1,719,345 and 3,052,068 for example) and many examples of stationarily mounted or mountable knife sharpeners (see U.S. Pat. Nos. 620,050; 2,542,472; 2,473,702; 1,474,636; 1,827,664; 1,451,526; 1,032,910 and 1,223,753, for example).

SUMMARY OF THE INVENTION

In accordance with the invention there is provided an improved knife sharpener for sharpening kitchen knives or the like which is adapted to be hand-held during use or to be releasably mounted in a stationary position during use on a storage and mounting bracket which can be permanently attached to a supporting object such as a table, a counter or a wall.

The knife sharpener comprises a handle, an end portion connected to the handle and blade sharpening means on the end portion. The storage and mounting bracket on which the knife sharpener is releasably mountable comprises means for securing the bracket to the supporting object. Interengageable means are provided on the knife sharpener and on the storage and mounting bracket for releasably attaching the knife sharpener to the storage and mounting bracket. Preferably, the end portion of the knife sharpener includes a plurality (two) of blade sharpening means of differing abrasiveness (coarse and fine) in spaced apart locations on the end portion, and including a blade-guiding slot for each of the sharpening means. A protective outwardly projecting flange member is disposed between the handle and the sharpening means to prevent injury to the user when the sharpener is hand-held. The storage and mounting bracket comprises a base portion and upwardly projecting members in spaced apart relationship on the base portion. The interengageable means are mounted on the ends of the knife sharpener and are mounted on the upwardly projecting members of the base portion. At least one of the upwardly projecting members is resiliently movable to enable engagement and disengagement of the interengageable means during mounting and demounting of the knife sharpener relative to the bracket. The interengageable means comprise detent-engaging recess means on either the knife sharpener or the bracket and detent means on either the knife sharpener or the bracket. Specifically, each of the upwardly projecting members of said bracket is provided with detent means and the opposite ends of the knife sharpener are provided with detent-engaging recess means.

In a preferred embodiment, the knife sharpener is fabricated of two molded plastic components which are substantially mirror images of each other and sonic welded together during manufacture. Each component has two pairs of integrally formed receiving elements formed on the inside surface of its half of the end portion into which one of each pair of small cylindrical ceramic sharpening elements are snap-fitted in a friction fit, instead of being sonic welded or glued.

The mounting bracket is made of plastic and comprises a base plate having mounting screw holes therethrough whereby it attaches to the supporting object, such as a wall or counter. The base plate has integrally formed slightly flexible end plates, and each end plate has a projection releasably engageable with an indentation on the sharpener end.

A knife sharpener and mounting and storage bracket therefor in accordance with the present invention offers several advantages over the prior art. For example, it is very convenient and versatile for a person to have the choice either of holding the sharpener while using it or of stationarily mounting it on the mounting/storage bracket while using it. Furthermore, the bracket serves as a convenient and permanent location for storing the sharpener when not in use. The bracket and the associated interengageable attachment means are simple in design and construction and convenient and reliable in use. Also, the sharpener gives the user the opportunity of using coarse or fine sharpening means of improved construction, as the situation requires, in the same implement. The sharpener is straight-forward in design and relatively easy and economical to fabricate and assemble. The sharpener employs improved state-of-the-art cylindrical sharpening elements which are firmly held in position by entrapment between the two molded halves of the sharpener without the need for adhesives. Other objects and advantages of the invention will hereinafter appear.

DRAWINGS

DESCRIPTION OF A PREFERRED EMBODIMENT

Figure 1:
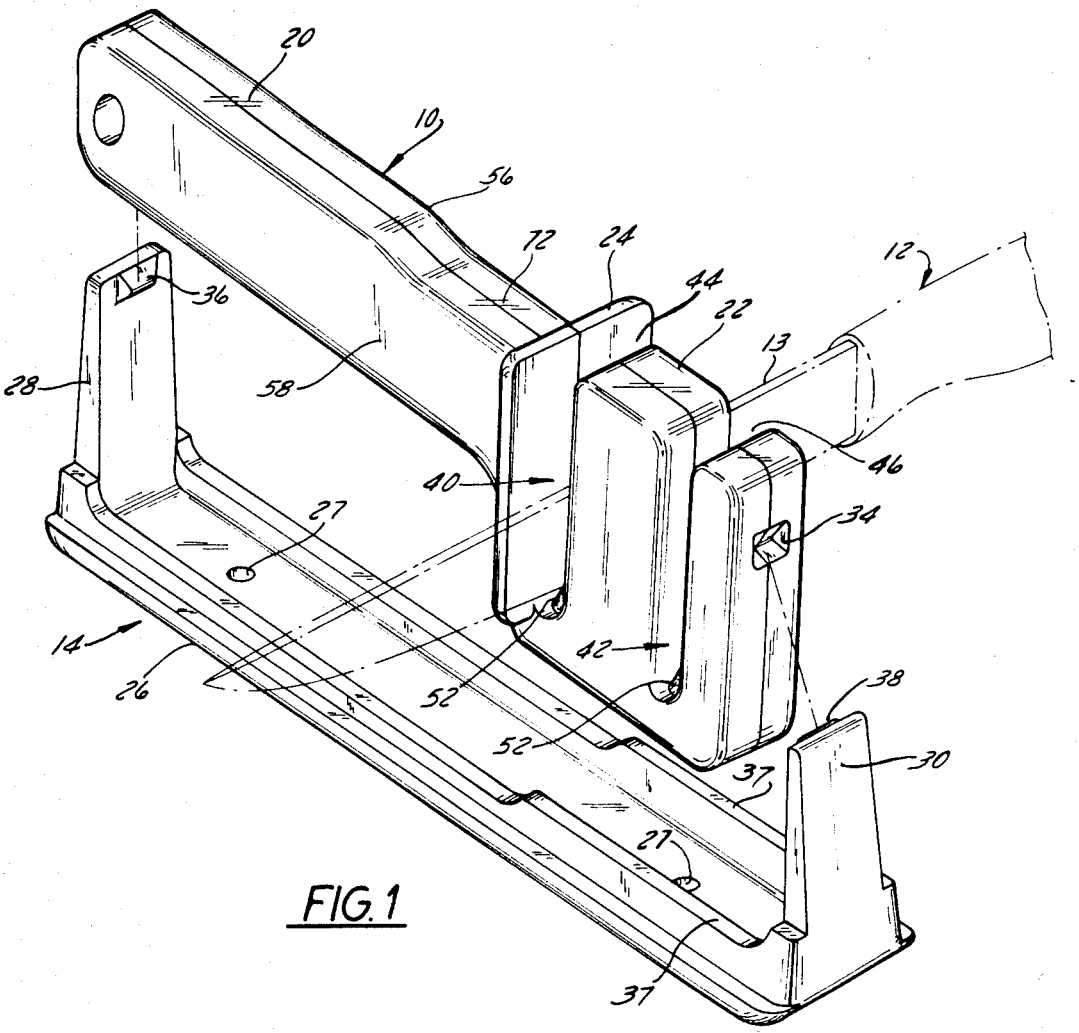
FIG. 1 is a perspective view of a knife sharpener and a mounting and storage bracket therefor showing the sharpener detached from the bracket and showing a knife (in phantom) associated with the sharpener.
Figure 2:
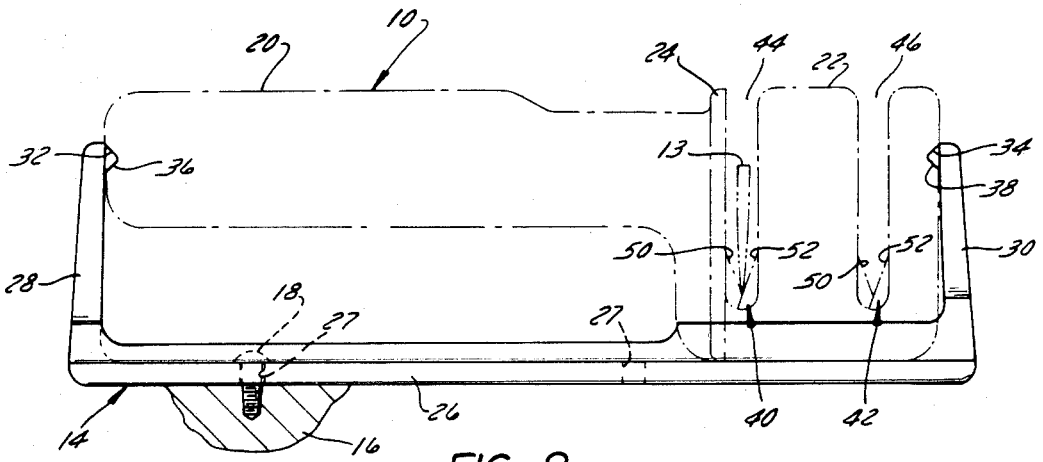
FIG. 2 is a reduced scale side elevation view of the bracket of FIG. 1 and showing the sharpener of FIG. 1 (in phantom) mounted thereon.
Figure 3:
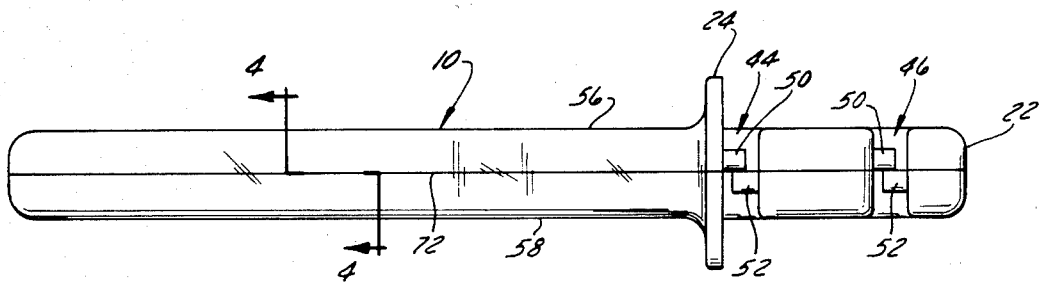
FIG. 3 is a top plan view of the sharpener of FIGS. 1 and 2.

Referring to FIGS. 1 and 2, in accordance with the invention there is provided an improved knife sharpener 10 for sharpening a kitchen knife 12 having a blade 13 which is adapted to be hand-held during use or to be releasably mounted in a stationary position during use on a storage and mounting bracket 14 which, as FIG. 2 shows, can be permanently attached to a supporting object 16 such as a table, a counter or a wall, as by fastening means such as a screw 18.

The knife sharpener 10 comprises a handle 20, an end or head 22 connected to the handle and blade sharpening means, hereinafter described in detail, on the head. A protective outwardly projecting flange member 24 is disposed between the handle 20 and the sharpening means on head 22 to prevent injury to the user when the sharpener 10 is hand-held during use.

The storage and mounting bracket 14 on which the knife sharpener 10 is releasably mountable comprises the aforesaid fastening means for securing the bracket to the supporting object 16 and further comprises a base portion 26 having a pair of screw holes 27 therein and upwardly projecting members 28 and 30 in spaced apart relationship on the base portion.

Interengageable means are provided as first engaging means on the knife sharpener 10 and as second engaging means on the storage and mounting bracket 14 for releasably attaching the knife sharpener to the storage and mounting bracket in stationary rigid relationship. The interengageable means comprise detents and detent-engaging recesses which are mounted on the opposite ends of the knife sharpener 10 and are mounted on the pair of upwardly projecting end members 28 and 30 located at opposite ends of the base portion 26. At least one of the upwardly projecting members 28 and 30, but preferably both, are resiliently movable to enable engagement and disengagement of the interengageable means during mounting and demounting of the knife sharpener 10 relative to the bracket 14. The interchangeable means comprise detent-engaging recesses 32 and 34 on the ends of the knife sharpener 10 and detent means 36 and 38 on the inside surfaces of the upwardly projecting members 28 and 30, respectively, of bracket 14. The interengageable means further comprise upwardly projecting members in the form of side walls 37 which project upwardly from base portion 26 of bracket 14 and engage the sides of head 22 of knife sharpener 10, as FIG. 2 shows.

The head 22 of the knife sharpener 10 includes a plurality (two) of blade sharpening means 40 and 42 of differing abrasiveness (coarse and fine) in spaced apart locations on the head 22. Head 22 includes a plurality (two) of blade-receiving slots 44 and 46, one blade slot for each of the sharpening means.

Each blade sharpening means 40 and 42 (which are of differing abrasiveness relative to each other) comprises at least one, but preferably two, blade sharpening elements 50 and 52, each in the form of a cylinder of ceramic abrasive, which are arranged in converging and overlapping relationship in a blade-receiving slot 44, 46 so as to be engageable by the sharp edge of the knife blade 13. The elements 50 and 52 are rigidly secured in place by entrapment, as hereinafter explained.

The mounting bracket 14 is preferably fabricated by molding in one piece from a suitable plastic.

Figure 4:
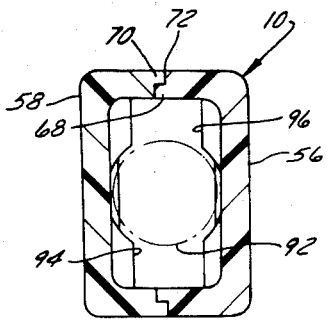
FIG. 4 is an enlarged cross-section view of the handle of the sharpener taken on line 4—4 of FIG. 3.
Figure 5:
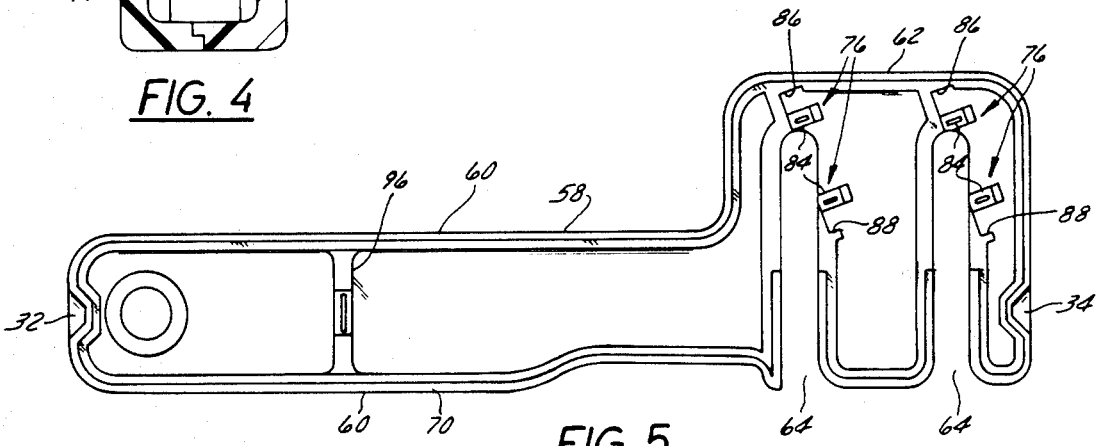
FIG. 5 is a plan view of the inner side of one of a pair of mating molded halves or sections of the sharpener of FIG. 3.
Figure 6:
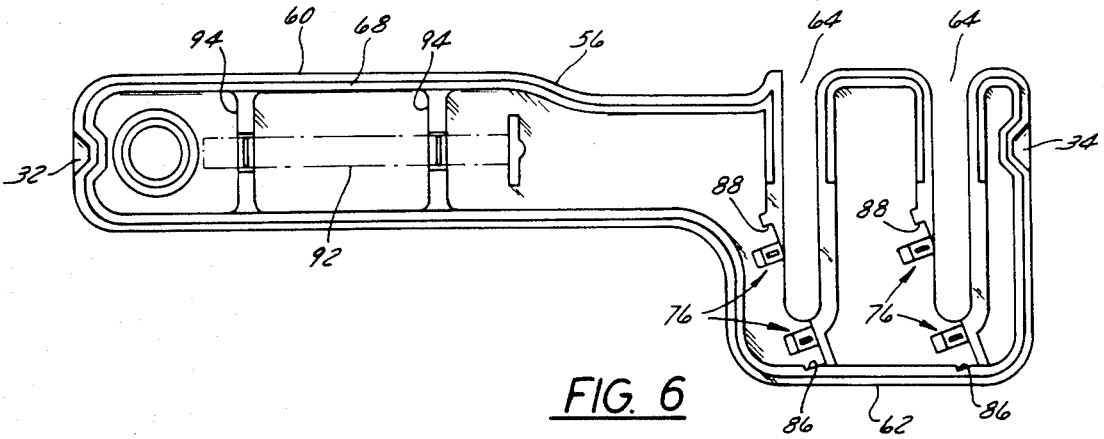
FIG. 6 is a plan view of the inner side of the other of the pair of mating molded halves or sections of the sharpener of FIG. 3.

As FIGS. 3 through 6 show, the knife sharpener 10 comprises a pair of molded plastic components 56 and 58 which are substantially mirror images of each other. Each component 56, 58 comprises a handle portion 60 and an integral head portion 62. The head portion 62 of each of the components 56, 58 comprises a plurality (two) of spaced apart slot portions 64 extending inwardly from an edge of the component transverse to the longitudinal axis of the component. Means are provided for securing the pair of components 56, 58 together in side-by-side relationship (FIG. 3) whereby said components define handle 20 and head 22 having the two blade-receiving slots 44 and 46 therein. As FIGS. 4, 5 and 6 show, such means comprise interlocking flanges 68 and 70 on components 56 and 58, respectively, which are sonic welded together at seam 72 in FIG. 4.

Each component 56, 58 has two pairs of integrally formed receiving elements 76 formed on the inside surface of its end portion 62 into which the cylindrical ceramic sharpening elements 50 and 52 are snap-fitted in a friction fit, instead of being sonic welded or glued. The blade sharpening means are thus secured by entrapment between pair of components 56, 58 when the latter are secured together. A portion of each element 50, 52 extends into its associated blade-receiving slot 44 or 46.

Figure 8:
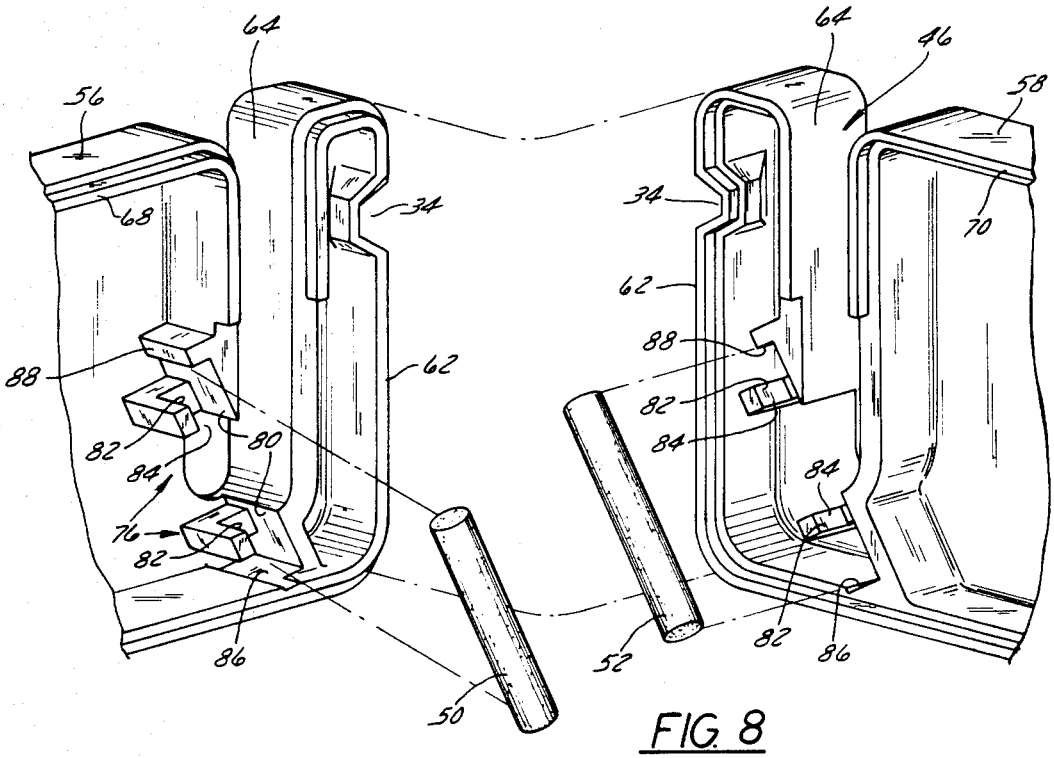
FIG. 8 is an exploded perspective view of a portion of the head end shown in FIG. 7 and shows one pair of blade sharpening elements associated therewith.
Figure 9:
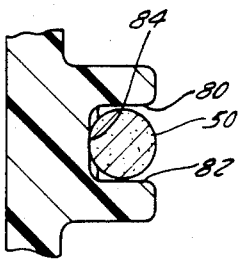
FIG. 9 is an enlarged cross-section view of a sharpening element and its molded receiving element or supporting means taken on line 9—9 of FIG. 7.
Figure 7:
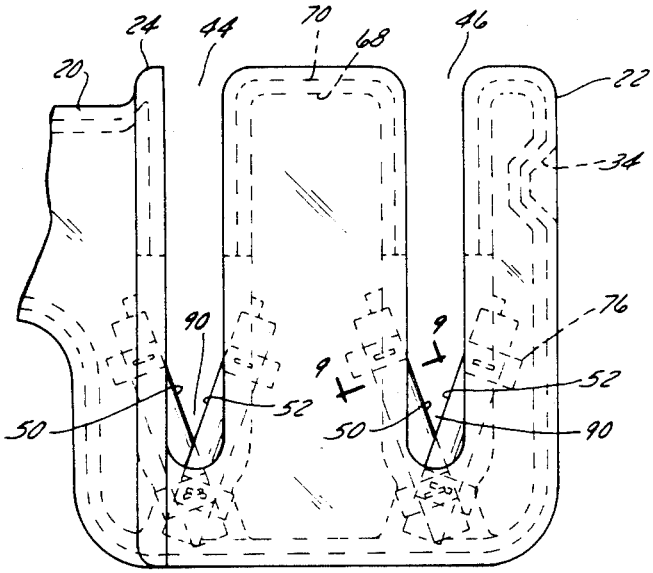
FIG. 7 is an enlarged side elevation view of the head end of the sharpener and shows the blade sharpening means mounted therein.

As FIGS. 7, 8 and 9 show, each receiving element 76 into which a ceramic sharpening element 50, 52 is inserted comprises two spaced-apart projections or surfaces 80 and 82 which define a groove 84 for receiving the sharpening element. Axial shifting or displacement of an element 50, 52 is prevented by a wall surface 86 at one end and by an integrally formed projection 88 at its other end. As FIG. 7 best shows, the sharpening elements 50 and 52 forming a pair converge and overlap relative to each other to define a V-shaped groove 90 in the associated slot 44 or 46 which is accessible to the edge of the knife blade 13 which is to be sharpened. The sides of each slot 44, 46 guide the blade 13 as it is moved reciprocably therein transversely to axis X during sharpening.

As FIGS. 4 and 6 show, for the sake of balance, a relatively heavy object, such as a metal bar 92 is disposed in handle 20 of sharpener 10 to compensate for the weight of the head 22 and its contents. Bar 92 is entrapped between molded projections 94 and 96.

I claim:

1. In combination:

a knife sharpener comprising a handle, an end portion connected to said handle and blade sharpening means on said end portion, said knife sharpener having opposite ends and said end portion having opposite sides;

a one-piece molded plastic storage and mounting bracket on which said knife sharpener is releasably mountable and comprising means for securing said bracket to a supporting object, said bracket comprising a base portion, a pair of upwardly projecting end members at opposite ends of said base portion, at least one of said end members being resiliently movable, and a pair of upwardly projecting side members at opposite sides of said base portion for receiving said end portion of said knife sharpener therebetween when said knife sharpener is mounted on said bracket;

and interengageable means on said knife sharpener and on said bracket for releasably attaching said knife sharpener to said bracket in stationary rigid relationship, said interengageable means on said knife sharpener comprising first engaging means located at opposite ends thereof, said interengageable means on said bracket comprising second engaging means located on said pair of upwardly projecting end members for engagement with said first engaging means, said one upwardly projecting end member being resiliently movable to enable engagement and disengagement of said first and second engaging means during mounting and demounting of said knife sharpener relative to said bracket.

2. A combination according to claim 1 wherein said portion of said knife sharpener includes a plurality of blade sharpening means of differing abrasiveness in spaced apart locations on said portion.

3. A combination according to claim 1 or 2 wherein said portion of said knife sharpener includes a blade-receiving slot for said blade sharpening means.

4. A combination according to claim 1 or 2 wherein said knife sharpener comprises a protective outwardly projecting member disposed between said handle and said sharpening means.

5. A combination according to claim 1 wherein said first engaging means comprise detent-engaging recess means formed on said handle and said end portion of said knife sharpener and wherein said second engaging means comprise detent means formed on said upwardly projecting end members of said bracket.

* * * * *